US005571257A

United States Patent [19]

Bruski et al.

[11] Patent Number: 5,571,257

[45] Date of Patent: Nov. 5, 1996

[54] COUPLER ARRANGEMENT IN PARTICULAR FOR RAILWAY CARS

[75] Inventors: Marek Bruski, S ł owackiego; Andrzej Chmielewski, Sienkiewicza; Józef K ę dzior, Klaudyny; Antoni Kubicki, Krasickiego; Kamimierz Milczarski, Chopina; Wojciech Pop ł awski, Afrykańska; Eugeniusz Strzyz, Zielona, all of Poland

[73] Assignee: Kamax, S.A. Fabryka Urzadzen Mechanicznych, Kanczuga, Poland

[21] Appl. No.: 198,313

[22] Filed: Feb. 18, 1994

[30] Foreign Application Priority Data

Aug. 16, 1993 [PL] Poland ..... 300098

[51] Int. Cl.[6] ..... B61G 9/22; B61G 9/14

[52] U.S. Cl. ..... 213/50; 213/40 R

[58] Field of Search ..... 213/10, 40 R, 213/50, 61, 64; 267/140, 293

[56] References Cited

U.S. PATENT DOCUMENTS

| | | | |
|---|---|---|---|
| 1,939,381 | 11/1929 | Barrows | 213/40 R |
| 2,767,859 | 10/1956 | Fillion | 267/293 |
| 3,164,264 | 1/1965 | Price et al. | 213/10 |
| 3,178,037 | 4/1965 | Kendall | 213/40 R |
| 3,368,697 | 2/1968 | Carlson | 213/40 R |

FOREIGN PATENT DOCUMENTS

| | | |
|---|---|---|
| 159972 | 1/1991 | Poland . |
| 97130 U | 8/1994 | Poland . |

*Primary Examiner*—S. Joseph Morano
*Attorney, Agent, or Firm*—Michael, Best & Friedrich; Witold A. Ziarno

[57] ABSTRACT

The invention improves performance characteristic of coupler arrangements; and embodies a cushioning device (8) which comprises an elastomeric shock absorber (9) whose bottom part (10) is held in a rear stop block (12) supported on a rear stop (7, 7'). The opposite section of the elastomeric shock absorber is slidably mounted in the casing (13) which includes a guide (14) closed by a fixedly attached front stop block (15), with the stop block abutting the front stop (6, 6'). Inside the casing the stop block abuts the piston rod (16) of the elastomeric shock absorber.

4 Claims, 6 Drawing Sheets

COUPLER ARRANGEMENT IN PARTICULAR FOR RAILWAY CARS

BACKGROUND AND DESCRIPTION OF THE INVENTION

The invention relates to a coupler arrangement.

The known coupler arrangements comprise a coupler arm, which is partially disposed in an underframe of a railway car, the said coupler arm being connected with the draw gear of a shock absorber by means of a coupler pin, whereas on the walls of the chamber there are provided front and rear stop means. The space contained between the front and rear stop means, the bottom of the draw gear and the head of the coupler arm is used to locate the cushioning device therein. The said space is usually rectangular in section. In the known embodiments the cushioning device comprises usually a friction-spring damper, a liquid spring or a rubber damper.

A known shock absorber fastening means for an autocoupler is disclosed in the Polish patent application No. 280535 which describes a shock absorber which is provided with a collar mounted between the ends of a casing, with said collar adhering, at the extreme distance from the end sill to the vertical supporting elements of the side walls of the chamber, with the said vertical elements resting on horizontal ribs at the side opposite to the end sill.

The disadvantage of the above coupler arrangements relies in operating restrictions caused by employed shock absorbers. Difficulties have been encountered when assembling hitherto known cushioning devices in a pocket of an automatic coupler, which was due to the fact that the cushioning device needed to be compressed in a press and transferred in this form to the coupler pocket by means of a special appliance.

Polish utility design application W-97130 describes a cushioning device whose casing has a shape of a sleeve closed with a bottom on one side, with the cylindrical elastomeric shock absorber being located in the said casing, with the piston rod of the said elastomeric shock absorber pointing towards the bottom of the sleeve and pressed upon the said bottom by means of a stop plate. The said stop plate is connected to the casing by means of screws which are fixedly attached to a stop plate, while in the casing the said screws pass through the bores in the lugs, which are located at the end of the casing opposite the bottom. Under the bolt heads there are provided U-shaped assembling washers.

Morover the description of the embodiments of the mentioned utility design application discloses that the cushioning device is mounted between the stop means. The front stop means that a stop plate abuts and the rear stop means which supports the bottom of the casing.

The disadvantage of the above device relies in the high cost of manufacturing the casing.

It is one important object of the present invention to obviate the above identified problems and disadvantages associated with known coupler arrangements.

In the accomplishment of this object, the cushioning device comprises an elastomeric shock absorber, whose bottom portion is mounted on a rear stop plate supported on the rear stop means, while the opposite portion of the shock absorber is slidably mounted in a casing. The said casing includes a guide bar, which is closed by a front stop plate. Inside the casing the piston rod of the elastomeric shock absorber abuts the said stop plate and this in turn abuts the front stop means. Location of the elastomeric shock absorber in the guide bar of a casing enhances the durability of the cushioning device because it protects the piston rod and the sealing means from the impact of transverse or side forces. Morover mounting the bottom portion of the elastomeric shock absorber on a rear stop block enables one to use and/or employ a longer shock absorber in the coupler pocket of the same size.

According to the present invention it is advantageous to employ a contractible mounting of the bottom section of the elastomeric shock absorber in a bore provided in a rear stop plate.

It is also advantageous to employ a guide bar whose length is smaller than the distance between the front stop plate and the rear stop plate of a fully compressed cushioning device. Due to this the excess force imposed on the cushioning device is transmitted by the cylinder of the elastomeric shock absorber after the pitch of the piston rod has been exhausted.

The guide bar has a shape of a sleeve in which a cylinder of elastomeric shock absorber is located and morover the said sleeve may be equipped with lugs, in which screw bolts are slidably installed, the said screw bolts being fixedly attached to the rear stop plate.

The guide bar may also have a shape like that of a box and in this case the cylinder of the elastomeric shock absorber on the side opposite to the bottom is provided with a flange.

Further improvements according to the invention are achieved by employing a box-shaped guide bar, which as a rectangular cross-section. In this case, in order to simplify the assembling procedure, it is preferred if the bottom section of the guide is shorter than the distance between the front stop block and the surface of the flange facing the rear stop block. In the case of the rectangular guide the flange is shaped as a rectangular plate preferably fixedly attached to a cylinder of the elastomeric shock absorber.

The various embodiments of the coupler arrangement of the present invention will be better understood by reference to the following drawings, where FIG. 1 is a longitudinal section of the coupler in a vertical plane;

Figure 1:
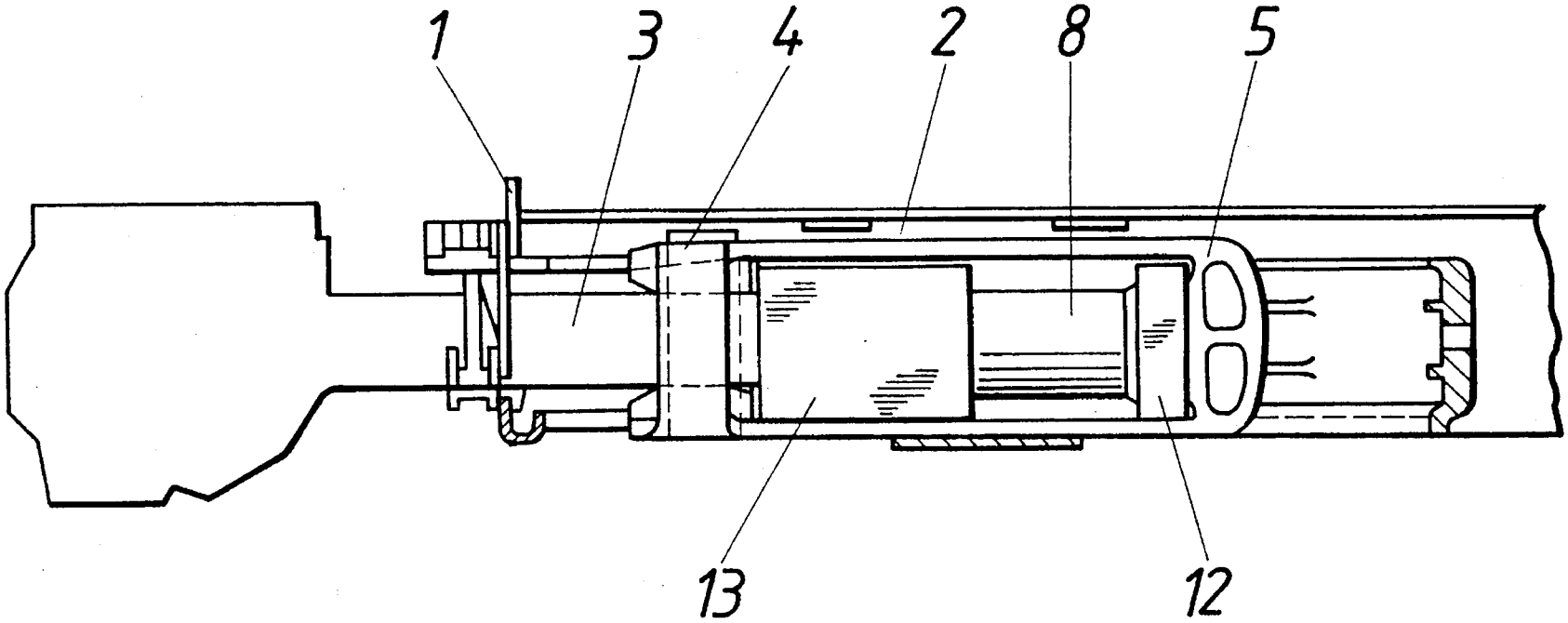
Figure 2:
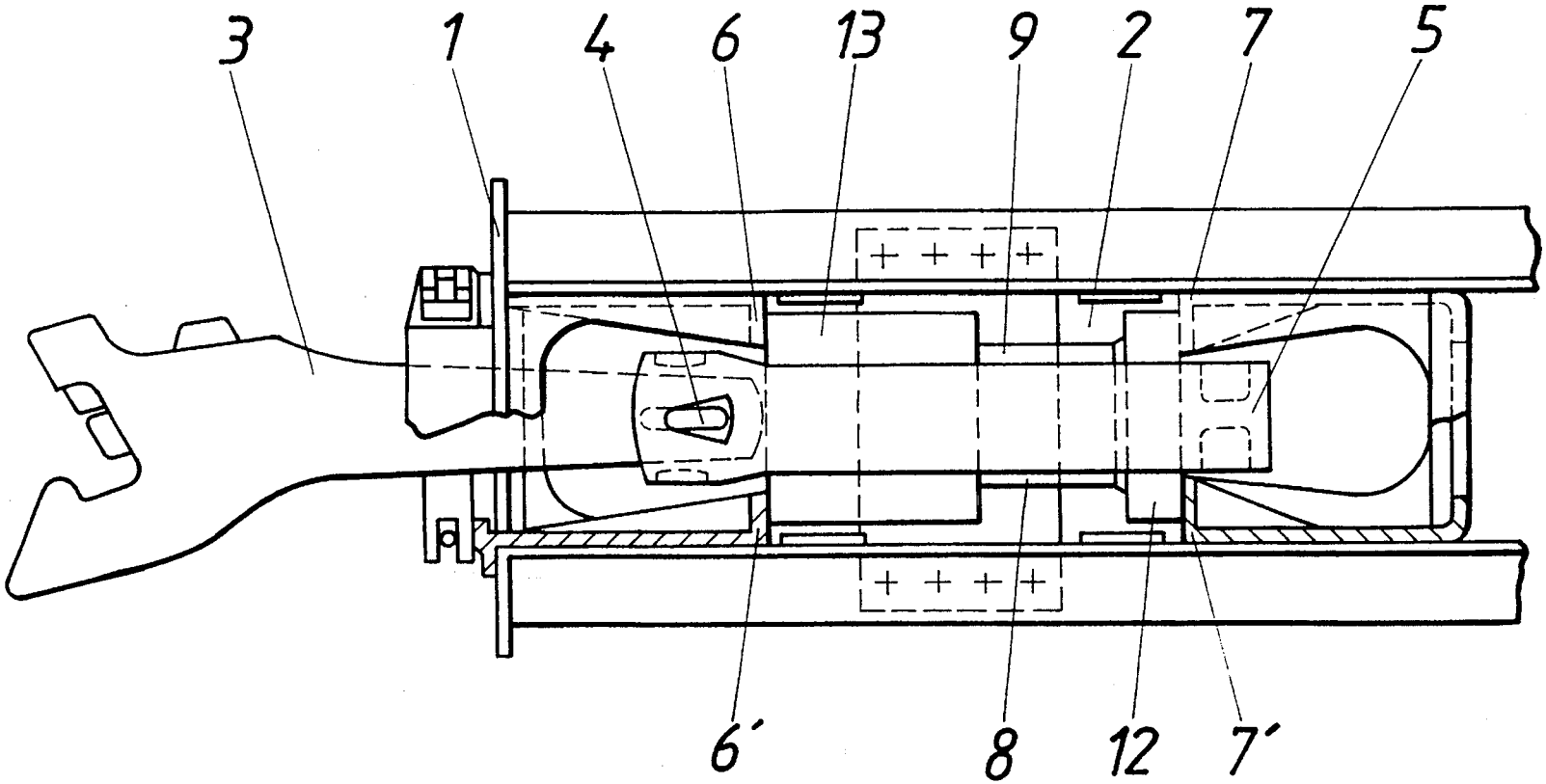
FIG. 2 is a longitudinal section of the coupler in a horizontal plate.
Figure 3:
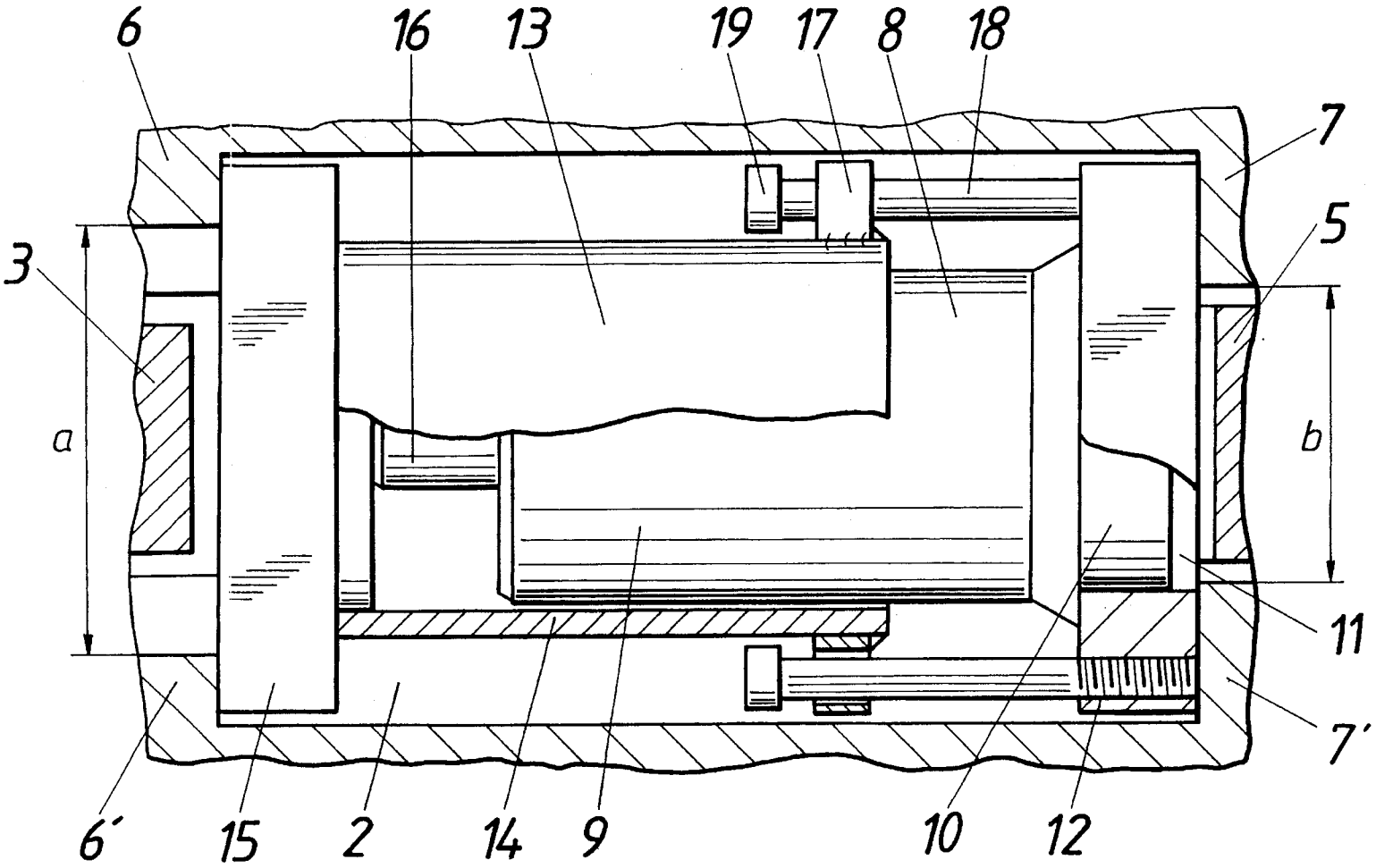
FIG. 3 is a fragmentary longitudinal sectional view of the automatic coupler having a cushioning device located in a coupler pocket, the said cushioning device including a sleeve-shaped guide bar.
Figure 4:
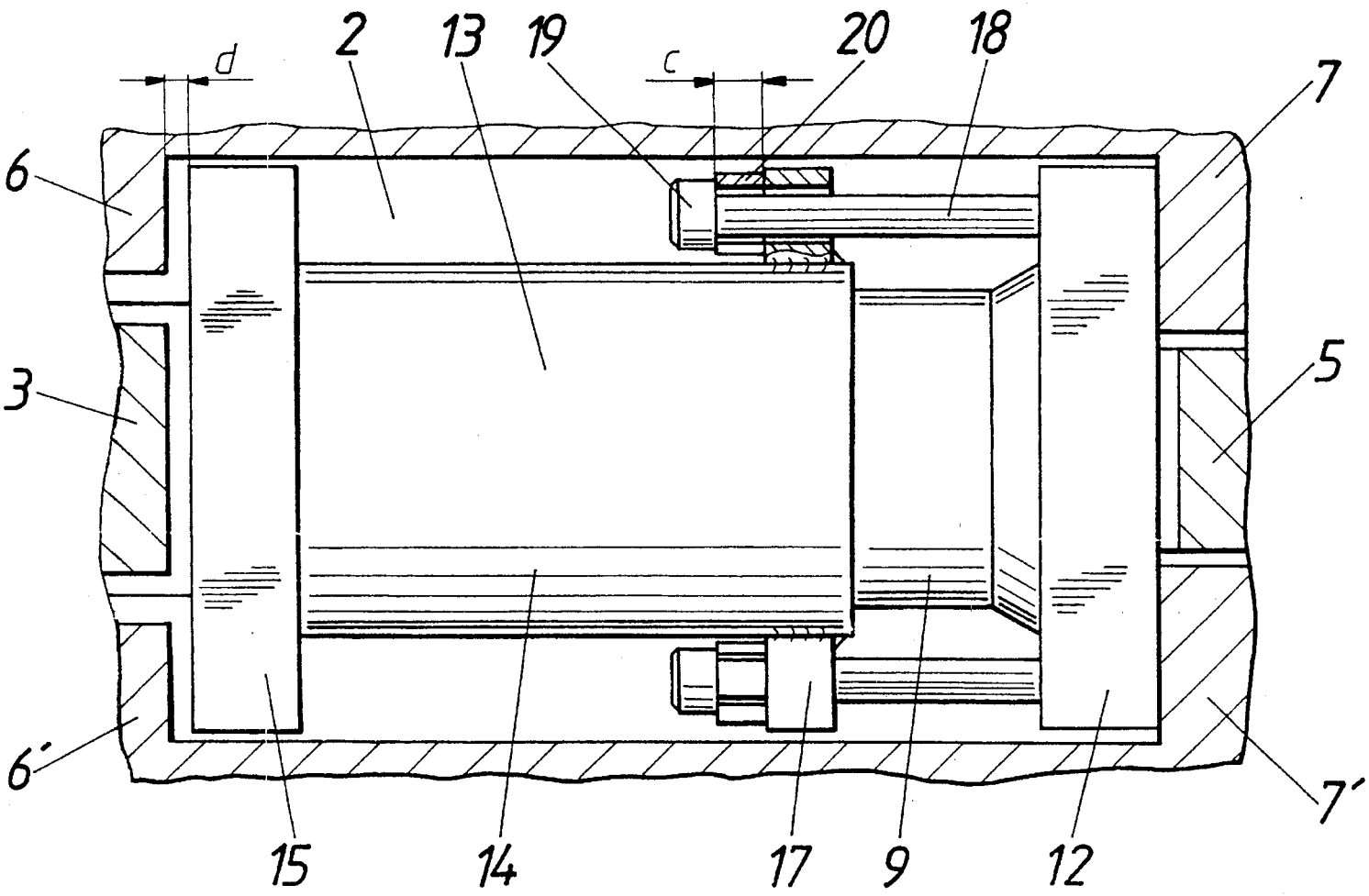
FIG. 4 is a fragmentary longitudinal sectional view of a coupler showing the assembling washers mounted on the screws of the cushioning device.

The underframe of a railway car 1 is provided with a rectangular chamber 2, in which a coupler arm 3 is partially located. The coupler arm is connected with the draw gear 5 by means of a coupler pin 4. On the walls of a chamber there are provided front resistance, or stop means 6, 6' and rear stop means 7, 7'. The spacing of the front stop means "a" is larger than the spacing of the rear stop means "b". The cushioning device 8 is located between the said front and rear stop means. The said cushioning device comprises an elastomeric shock absorber 9, whose bottom part or section 10 is contractibly mounted in a bore 11 of the rear stop block 12. The said stop plate has a shape of a rectangle abutting the rear stop means and/or the draw gear. The section of the elastomeric shock absorber opposite to the bottom part is slidably mounted in a casing 13, which is supported outwardly on the front stop means and/or coupler arm. The embodiment depicted in FIG. 3 and FIG. 4 illustrates the casing with the sleeve-shaped guide bar 14, which is closed from one side by a fixedly attached front stop plate 15. In the casing, the piston rod 16 of the elastomeric shock absorber abuts the front stop plate. The guide bar is provided with lugs 17, through which pass the screw bolts 18 attached to the rear stop plate 12. Between the lugs 17 and the bolt heads 19 the assembling washers 20 are mounted during the assembling procedure of the cushioning device in a coupler pocket. The said assembling washers are U-shaped and their thickness "c" is larger than the required longitudinal assembling clearance "d".

The total end of the guide bar 14 is smaller than the distance between the front stop plate 15 and the rear stop plate 12, the cushioning device being fully compressed.

Figure 5:
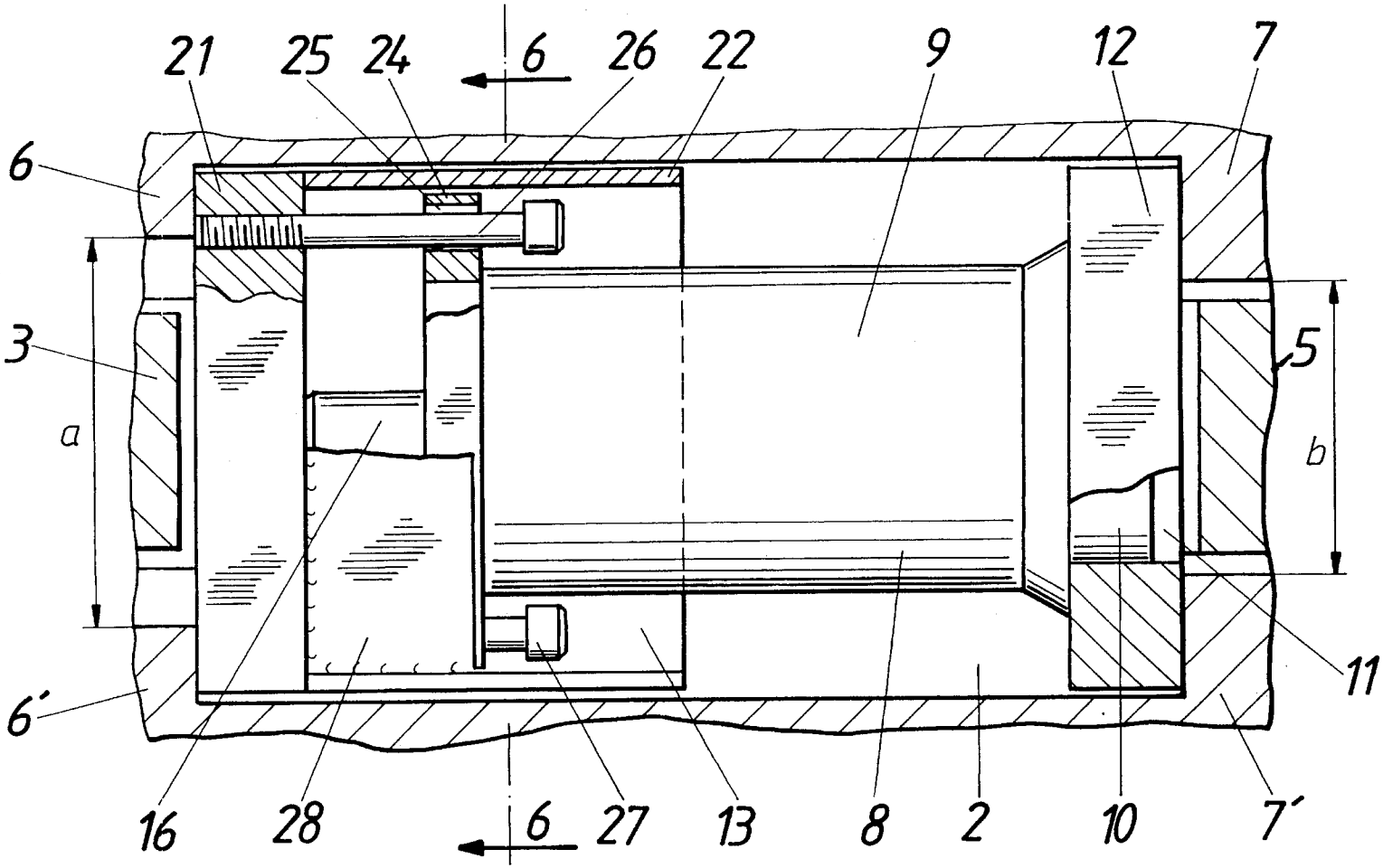
FIG. 5 is a fragmentary longitudinal sectional view of the bottom plan of the coupler having a box-shaped guide means.
Figure 6:
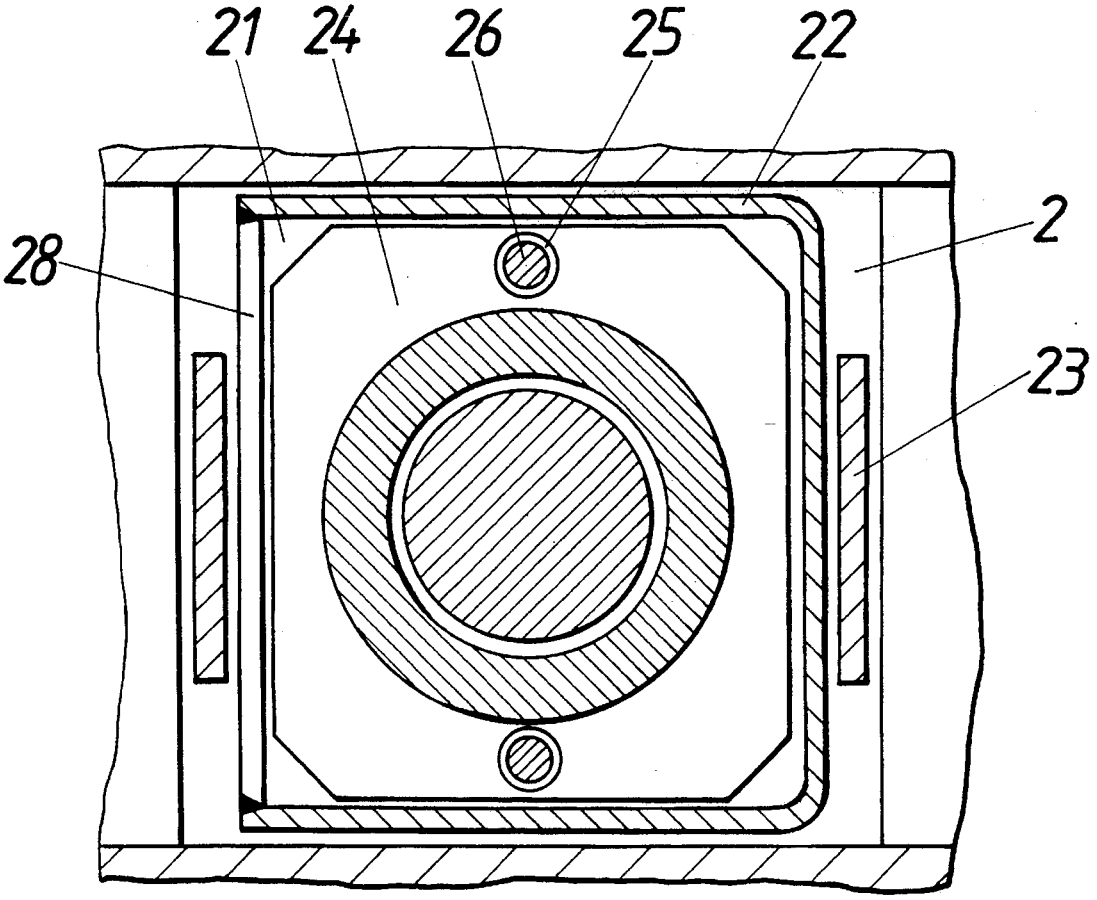
FIG. 6 is a transverse sectional view of the cushioning device equipped with a box-shaped guide means taken along line 6—6 of FIG. 5.

In the embodiment depicted in FIG. 5, there is disclosed a casing comprising a front stop plate 21 with fixedly attached box-shaped guide bar 22. Moreover, the rectangular outline of the casing enables to slidably mount the cushioning device in a coupler pocket between the arms 23 of the draw gear. Inside a box-shaped guide bar a flange 24 is slidably mounted, the said flange having approximately rectangular shape, and being contractibly attached to the cylinder of the elastomeric shock absorber opposite to its bottom section. Moreover, the flange is equipped with bores, in which the screw bolts 26 having bolt heads 27 are lossely mounted. The screws are fixedly attached to the front stop plate. Moreover, the length of the bottom part 28 of the box-shaped guide bar is smaller than the distance between the front stop plate; and the surface of the flange facing the rear stop plate; and the cushioning device being expanded to its limit between the stop means. Irrespective of the design of the casing the total length of the guide bar 14, is smaller than the distance between the front stop plate 15, and the rear stop plate 12, as compared to the cushioning device fully compressed.

The design disclosed in the present invention enables one to assemble the cushioning device in a coupler arrangement in a precompression mode. To achieve this the cushioning device is mounted in a coupler pocket 2 between the front stop means 6, 6' and the rear stop means 7, 7' after the initial compression, which affords the size of the cushioning device to correspond to the length of the coupler pocket, the said size being diminished by a required assembling clearance "d". This size of the cushioning device is maintained during the assembling procedure by means of screws 18 connecting lugs 17 with the rear stop plate 12, the assembling washers being in advance mounted between the screw heads 19, and the surface of the lug or the surface of the collar of the assembly washers. After the cushioning device has been mounted in a coupler pocket and after the subsequent compression, which is, by way of example, a result of the initial operational use of the coupler arrangement, the assembling washers are expelled from the coupler. If the coupler includes a cushioning device provided with a box-shaped guide means 22 the expulsion of the assembling washers from under the bolt heads 27 of the screws 26 is facilitated by the bottom part 28, whose length prohibits the retention of the said assembling washers inside the cushioning device.

When external forces are imposed on the coupler arrangement the rear stop plate 12 of the cushioning device rests on the rear stop means 7, 7', while the front stop plate 15, abuts the front stop means 6, 6'. The longitudinal draft force imposed on the coupler arm 3 is transmitted through the coupler pin 4 and the draw gear 5 to the rear stop block 12, which in turn transmits it to the elastomeric shock absorber 9. After the initial tension for the shock absorber is exceeded, the piston rod 16 moves inwardly in the cylinder of the shock absorber proportionally to the imposed force. Simultaneously, longitudinal load is transmitted through the front stop plate 15, and front stop means 6, 6' to the railway car underframe 1. When the longitudinal buff force is imposed on the coupler arm the said arm imparts it, through the front stop plate 15, to the piston rod 16 of the elastomeric shock absorber 9. As a result, the piston rod moves inwardly in the cylinder of the shock absorber, which in turn interacts with the rear stop means 7, 7' through the rear stop plate 12 attached to the bottom 10 of the shock absorber. The said stop means mounted on the wall of the chamber 2 transmit the load to the railway car underframe 1.

In the case of the coupler arrangement being exposed to the forces exceeding the characteristics of the shock absorber, after the pitch of the piston rod 16 has been exhausted, the front stop plate 15, abuts against the cylinder of the elastomeric shock absorber 9, which protects the guide bar 14, from damage.

What is claimed is:

1. A coupler arrangement, comprising a coupler arm (3) partially disposed in a chamber located in a railway car underframe (1), said coupler arm (3) being located between a front stop means (6,6'); said coupler arm (3) being connected with a draw gear (5) by means of a coupler pin (4); and said draw gear (5) being located between a rear stop means (7,7'), said front and rear stop means being fixedly attached to the walls of the chamber (2); a cushioning device (8) being mounted between said coupler arm and said draw gear, inside the chamber (2), in a space limited by the front stop means (6,6') and said coupler arm on one side and said rear stop means and said draw gear on the other side, said coupler arrangement being characterized in that the cushioning device (8) comprises an elastomeric shock absorber (9) whose bottom section (10) is located in a rear stop plate (12) abutting the rear stop means (7,7'), whereas the opposite section of said elastomeric shock absorber is slidably mounted in a casing (13) formed by a guide bar (14), said guide bar being closed by a front stop plate (15) fixedly attached thereon, with said front stop plate abutting said front stop means; with said piston rod (16) of said elastomeric shock absorber abutting said front stop plate; wherein said elastomeric shock absorber is compressed under buff loads by movement of said front stop plate and under draft loads by said rear stop plate.

2. A coupler arrangement according to claim 1, wherein said rear stop plate (12) is provided with a bore (11) in which the bottom section of (1) of said elastomeric shock absorber is contractibly mounted.

3. A coupler arrangement according to claim 1, wherein the length of said guide bar is smaller than the distance between said front stop plate and said rear stop plate when said cushioning device is fully compressed.

4. A coupler arrangement, comprising a coupler arm (3) partially disposed in a chamber located in a railway car underframe (1), said coupler arm (3) being located between a front stop means (6,6'); said coupler arm (3) being connected with a draw gear (5) by means of a coupler pin (4); and said draw gear (5) being located between a rear stop means (7,7'), said front and rear stop means being fixedly attached to the walls of the chamber (2); a cushioning device (8) being mounted between said coupler arm and said draw gear, inside the chamber (2), in a space limited by the front stop means (6,6') and said coupler arm on one side and said rear stop means and said draw gear on the other side, said coupler arrangement being characterized in that the cushioning device (8) comprises an elastomeric shock absorber (9) whose bottom section (10) is located in a rear stop plate (12) abutting the rear stop means (7,7'), whereas the opposite section of said elastomeric shock absorber is slidably mounted in a casing (13) formed by a guide bar (14), said guide bar being closed by a front stop plate (15) fixedly attached thereon, with said front stop plate abutting said front stop means; with said piston rod (16) of said elastomeric shock absorber abutting said front stop plate; and wherein said casing (13) is provided with a sleeve-shaped guide bar (14) having lugs (17), in which screw bolts (18) are loosely mounted, and said screw bolts being fixedly attached to said rear stop plate; wherein said elastomeric shock absorber is compressed under buff loads by movement of said front stop plate and under draft loads by said rear stop plate.

* * * * *